US006217482B1

(12) United States Patent
Yoo et al.

(10) Patent No.: US 6,217,482 B1
(45) Date of Patent: Apr. 17, 2001

(54) ENTERTAINMENT AND EXERCISE DEVICE

(76) Inventors: Dae-Sik Yoo; Kil-Hong Kim, both of 304 Sungbo Building, 437-1, Gurobon-Dong, Guro-ku, Seoul (KR)

( * ) Notice: Subject to any disclaimer, the term of this patent is extended or adjusted under 35 U.S.C. 154(b) by 0 days.

(21) Appl. No.: 09/444,169

(22) Filed: Nov. 19, 1999

(30) Foreign Application Priority Data

Sep. 4, 1999 (KR) ..... 99-37559

(51) Int. Cl.[7] ..... A63B 23/00
(52) U.S. Cl. ..... 482/10; 482/148; 601/39
(58) Field of Search ..... 482/110, 79; 446/236, 446/490, 135, 134; 601/39, 79; 2/209.13, 171.2; 607/109, 110; 606/204

(56) References Cited

U.S. PATENT DOCUMENTS 2,051,366 * 8/1936 Catron ..... 482/10
2,958,156 * 11/1960 Schmahl et al. ..... 482/10
3,866,910 * 2/1975 Herring ..... 482/10
4,006,556 2/1977 Williams ..... 46/228
5,569,134 10/1996 Nordanger ..... 482/110
5,807,217 9/1998 Endelman ..... 482/122
5,997,449 * 12/1999 Lee ..... 482/131
6,110,080 * 8/2000 Niv ..... 801/39

* cited by examiner

*Primary Examiner*—Jerome W. Donnelly
(74) *Attorney, Agent, or Firm*—Fish & Associates, LLP; Robert D. Fish; Sandra P. Thompson

(57) ABSTRACT

Disclosed is an entertainment and exercise device which allows exercise by placing it on a person's body and swiveling the body. The entertainment and exercise device has a flexible circular belt and a turning member rotating along the periphery of the belt. When the user wears the entertainment and exercise device on his body and swivels the body, the turning member rotates about the belt, thereby the user obtains an exercise effect and a finger-pressure effect. Also, the entertainment and exercise device of the present invention is convenient to carry and store, thereby being used for exercise irrespective of the exercising area.

14 Claims, 12 Drawing Sheets

ENTERTAINMENT AND EXERCISE DEVICE

BACKGROUND OF THE INVENTION

1. Field of the Invention

This invention relates to an entertainment and exercise device, and more particularly to an entertainment and exercise device which allows waist and neck exercise by placing it at a person's midsection or head and swiveling the body.

2. Prior Art

Generally, a hula hoop used for recreation and exercise is formed from a ring shaped plastic tube, and is an exercise instrument for training a person's body by placing it at the waist and swiveling the hips.

Conventionally, there have been disclosed many techniques related to the hula hoop. For example, U.S. Pat. No. 4,006,556 has taught a hula hoop having illuminating effect, and U.S. Pat. No. 5,569,134 has taught a collapsible hula hoop comprising a number of extended separate tube sections. Also, U.S. Pat. No. 5,807,217 has disclosed an elastically deformable circular ring shaped device.

However, because the hula hoop only allows for the simple exercise by swiveling the waist, the user is apt to feel repugnant.

Further, because many people have no skill to revolve the hula hoop which frequently cause the hula hoop to fall from their body, there is a drawback that they can't continuously use the hula hoop.

Furthermore, the big size causes difficult to carry the hula hoop due.

SUMMARY OF THE INVENTION

To solve the above problems, it is the object of the present invention to provide an entertainment and exercise device which obtains a continuous exercise effect and a finger-pressure effect by placing it on a person's body and swiveling the waist or the head.

It is another object of the present invention to provide an entertainment and exercise device which is easily portable and increases interest of use.

To obtain these objects, the entertainment and exercise device comprises a belt being circular and flexible, of which one portion is disconnected; a turning member rotating along a periphery of the belt and elongated outwardly from the belt; a rotating means installed on the periphery of the belt for rotating the turning member; and a locking means installed in the belt for connecting and disconnecting the belt. Also, a plurality of permanent magnets are mounted on an inner periphery of the belt.

The rotating means comprises a guide rail having a C-shaped section and longitudinally formed on the periphery of the belt; and a sliding plate inserted in the guide rail to slide along the guide rail, the sliding plate having a ball bearing at each of two end portions and a protrusion at a central portion.

The locking means comprises a lug projected respectively on an upper face and a lower face of one part of the disconnected belt; a hook connected to the lug; and a ring projected respectively on an upper face and an lower face of the other part of the disconnected belt, wherein the hook is separably combined with the ring.

As another embodiment of the present invention, the rotating means comprises a guide rail having an I-shaped section and longitudinally formed on the periphery of the belt; and a carrier supporting an upper portion of the guide rail to slide along the guide rail, the carrier having two ball bearings between both end portions of the carrier and the upper portion of the guide rail, and a protrusion at a central portion.

As a further embodiment of the present invention, an entertainment and exercise device comprises a disconnected belt being circular and flexible, and forming a guide recess along a longitudinal periphery of the belt; a turning member rotating along a longitudinal periphery of the belt and elongated outwardly from the belt, the turning member having a first mass rotatably inserted in the guide recess of the belt, a connecting bar of which one end is connected with the first mass, and a second mass jointed with the other end of the connecting bar; and a locking means installed in the belt for connecting and disconnecting the belt.

At this time, a pair of first holes are formed on an end face of one part of the disconnected belt, a pair of second holes are formed on an end face of the other part of the disconnected belt, and a pair of securing holes are formed on the periphery of the other part of the disconnected belt in order to vertically communicate with the second holes.

Furthermore, the locking means comprises a first fixing member inserted in each first hole; a second fixing member inserted in each second hole and forming a slit in a periphery thereof; a pin of which one end is screwed into the first fixing member and the other end is inserted in the second fixing member, the pin having a groove formed along a periphery of the other end thereof; a button inserted in each securing hole and having a rib fitted into the groove of the pin through the slit of the second fixing member; a spring placed on a head portion of the button for applying elastic force on the button; and a cover for restraining movement of the spring and covering the securing hole.

As a further embodiment of the present invention, the entertainment and exercise device has a helmet for wearing on the head; a rotating means integrally installed on the helmet; and a turning member separably combined with the rotating means and elongated outwardly from the helmet.

Accordingly, the entertainment and exercise device of the present invention is convenient to carry and keep, thereby being used for the exercise irrespective of the exercising area. Also, the entertainment and exercise device obtains a simple finger-pressure effect and increases interest.

BRIEF DESCRIPTION OF THE DRAWINGS

This invention will be better understood and its various objects and advantages will be more fully appreciated from the following description taken in conjunction with the accompanying drawings, in which.

DETAILED DESCRIPTION OF THE PREFERRED EMBODIMENT

Hereinafter, a first preferred embodiment according to the present invention will be described in detail with reference to the drawings.

Figure 1:
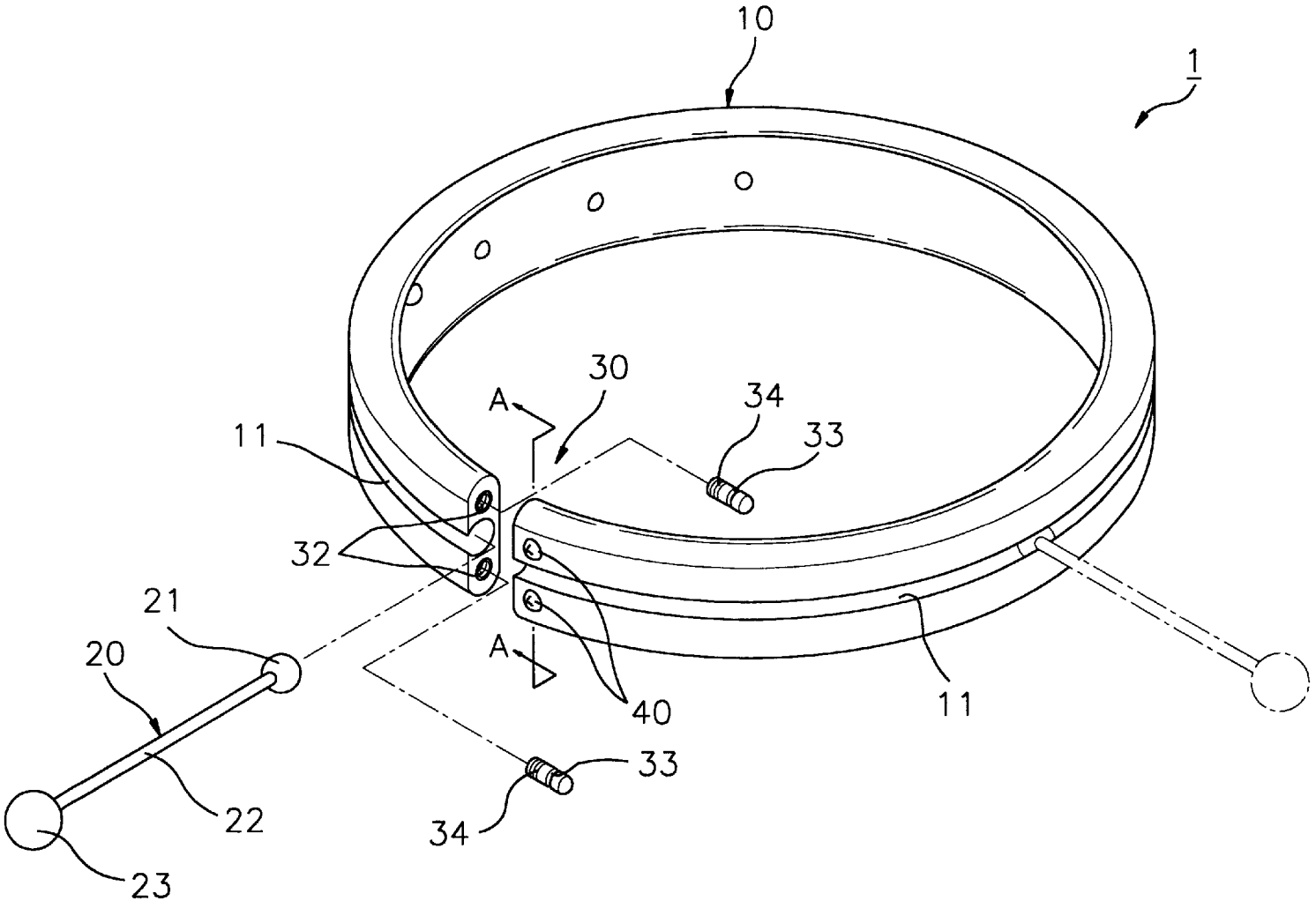
FIG. 1 is an exploded-perspective view of an entertainment and exercise device according to a first embodiment of the present invention.
Figure 2:
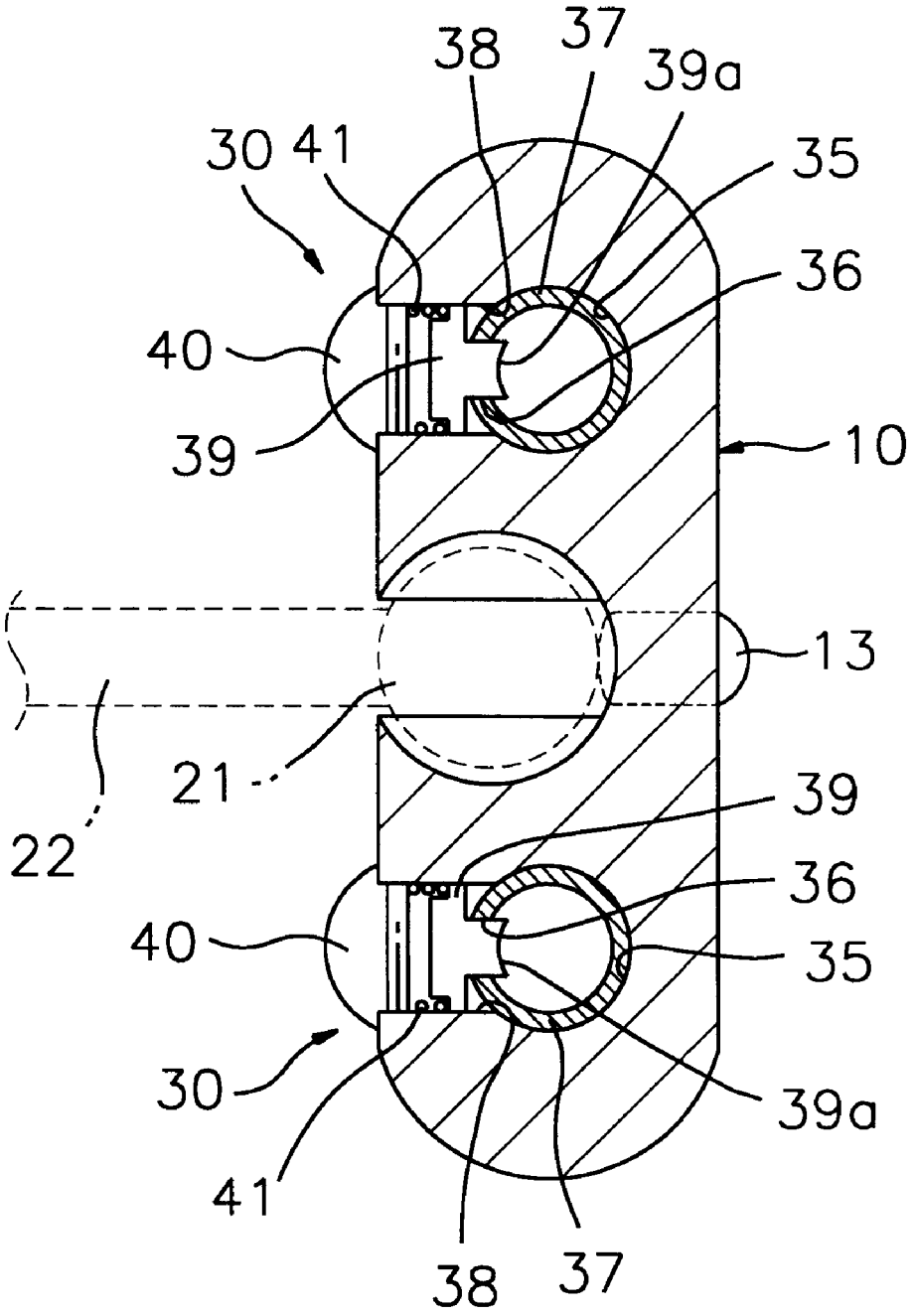
FIG. 2 is a sectional view taken substantially along the lines A—A of FIG. 1.
Figure 3:
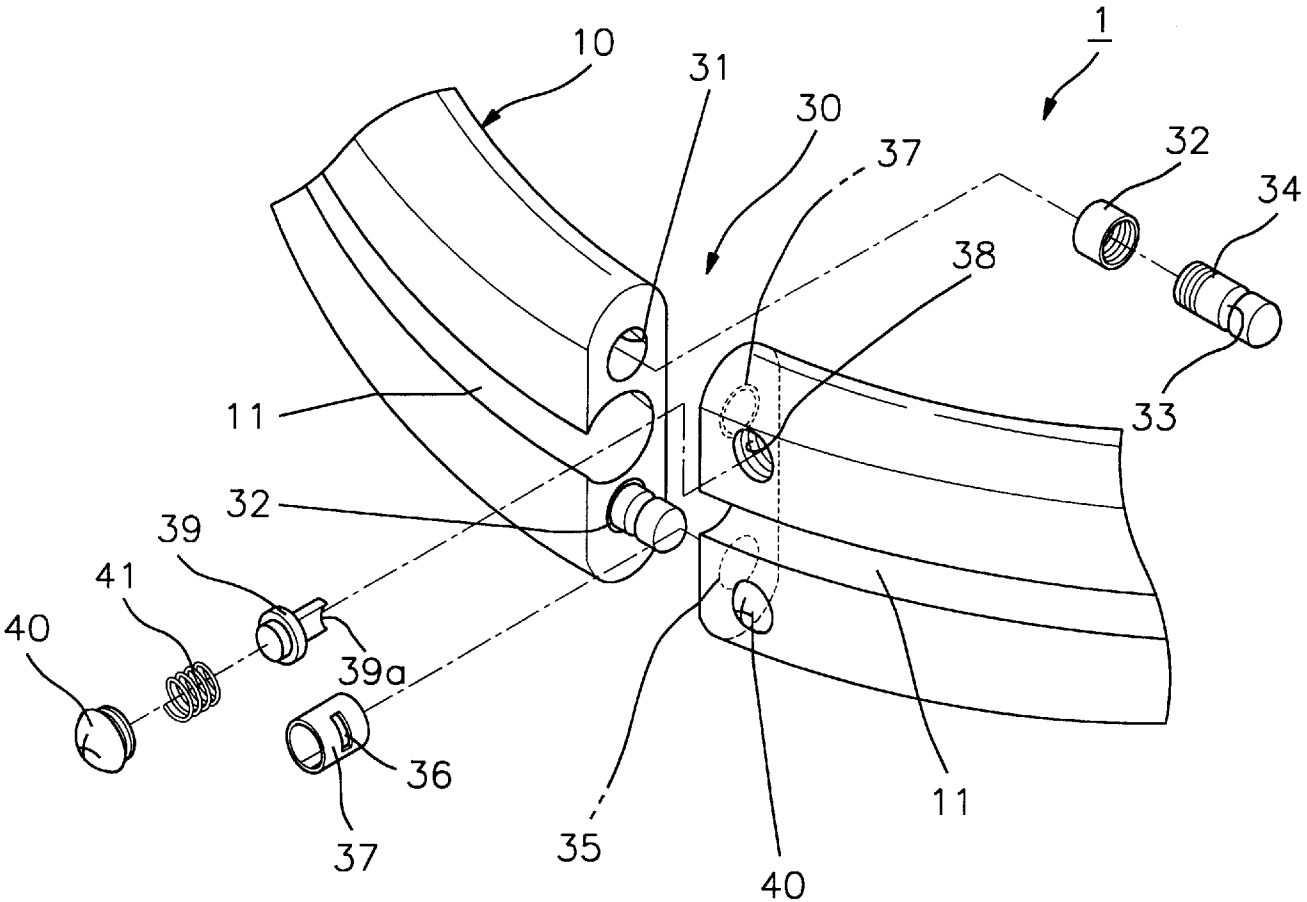
FIG. 3 is an exploded-perspective view showing a locking means of the entertainment and exercise device according to the first embodiment of the present invention.

FIG. 1 is an exploded-perspective view of an entertainment and exercise device according to a first embodiment of the present invention, FIG. 2 is a sectional view taken substantially along the lines A—A of FIG. 1, and FIG. 3 is an exploded-perspective view showing a locking means of the entertainment and exercise device according to the first embodiment of the present invention.

As shown in FIG. 1 through FIG. 3, the entertainment and exercise device 1 according to the first embodiment of the present invention comprises a belt 10 placed at a person's body and a turning member 20 turning along a longitudinal periphery of the belt 10.

The belt 10 made from a flexible synthetic resin is a circular belt of which one portion is disconnected, and has a guide recess 11 along a central portion of the longitudinal periphery of the belt. The guide recess 11 has an opened-circular section and is opened on the periphery of the belt 10 by a desired range. The opened range is determined by size and shape of the turning member 20.

A plurality of permanent magnets 13 are projected on an inner periphery of the belt 10 contacting with the person's body in order to obtain a finger-pressure effect.

A pair of first holes are formed on an end face of one part of the disconnected belt, and a pair of second holes are formed on an end face of the other part of the disconnected belt with each second hole opposed to each first hole. Also, a pair of securing holes are formed on the periphery of the other part of the disconnected belt in order to vertically communicate with the second holes.

The turning member 20 has a first mass 21 rotatably inserted in the guide recess 11 of the belt 10, a connecting bar 22 of which one end is connected with the first mass 21, and a second mass 23 jointed with the other end of the connecting bar 22.

A diameter of the first mass 21 is smaller than that of a cross-section of the guide recess 11 so that the first mass 21 is apt to slide in the guide recess 11. Also, a diameter of the second mass 23 is greater than that of the first mass 21.

Preferably, the second mass 23 is made from flexible material such as rubber or synthetic resin so that the second mass 23 wouldn't injure others if upon being rotated it made impact on them. In addition, the entertainment and exercise device may obtain a fireworks effect in the night by applying a luminous paint on the second mass 23.

The belt 10 has a locking means 30 for separably connecting the disconnected portion of the belt 10.

The locking means 30 comprises a first fixing member 32, a second fixing member 37, a pin 34, a button 39, a spring 41, and a cover 40.

The first fixing member 32 is inserted and secured in the first hole 31 by a bonding or welding. The second fixing member 37 is inserted in the second hole 35 and has a slit 36 on a periphery thereof.

One end of the pin 34 is screwed into the first fixing member, and the other end is inserted in the second fixing member 37. Also, a groove 33 is formed along an entire periphery of the other end of the pin 34, and a front end of the groove 33 has a rounded-shape.

The button 39 inserted in the securing hole 38 has a rib 39*a* which is fitted in the groove 33 of the pin 34 through the slit 36 of the second fixing member 37.

The cover 40 is screwed into the securing hole 38, and the spring 41 is disposed between the cover 40 and the button 39 for applying elastic force on a head portion of the button 39. That is, the spring 41 is supported on the head portion of the button 39.

The turning member 20 is mounted and separated on and from the belt 10 by the locking means 30.

Hereinafter, the operation of the first embodiment according to the present invention will be described.

Before using the entertainment and exercise device, the user inserts the turning member 20 into the belt 10, and wears the belt 10 on his/her body.

Figure 4A:
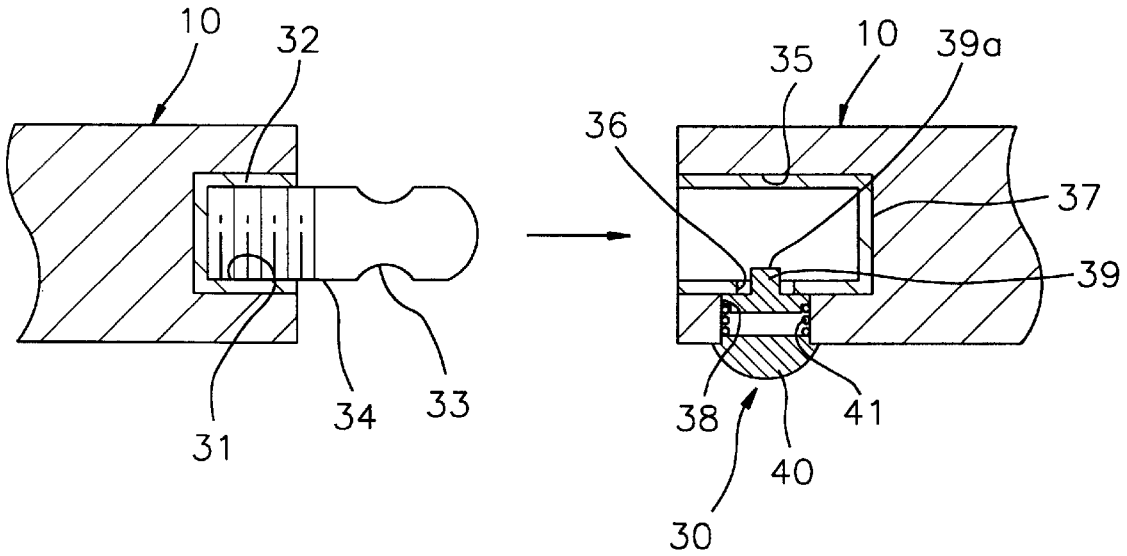
FIG. 4A is a sectional view showing the state before the locking means of FIG. 3 is locked.
Figure 4B:
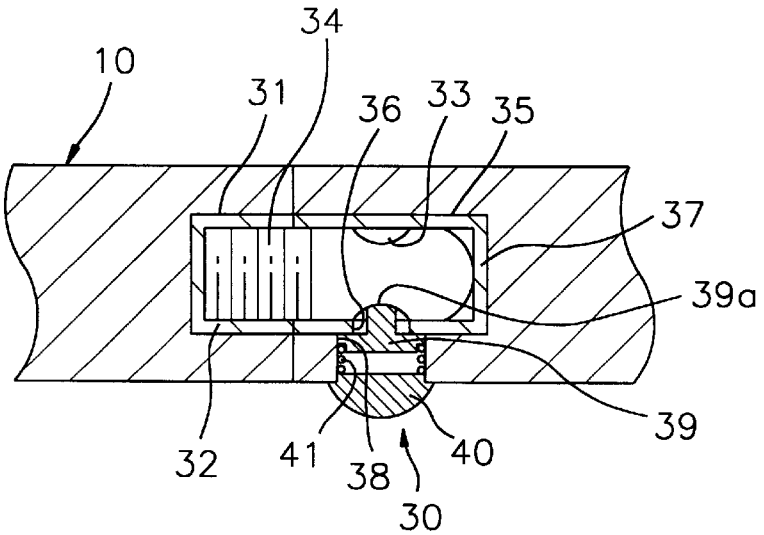
FIG. 4B is a sectional view showing the state after the locking means of FIG. 3 is locked.

FIG. 4A is a sectional view showing the state before the locking means of FIG. 3 is locked, and FIG. 4B is a sectional view showing the state after the locking means of FIG. 3 is locked.

As shown in FIG. 4A and FIG. 4B, when the user inserts the turning member 20 into the guide recess 11 of the belt 10 and connects one part of the disconnected belt 10 with the other part thereof, the other end of the pin 34 of which one end is screwed into the first fixing member 32 is inserted in the second fixing member 37. At this time, because the front end of the pin 34 has a rounded-shape, the pin 34 pushes the rib 39*a* of the button 37 outwardly and is inserted in the second fixing member 37. The rib 39*a* moved outwardly is returned by restoring force of the spring 41, being fitted in the groove 33 of the pin 34. Accordingly, the belt 10 is connected in an operable state.

On the other hand, when the user takes off the belt 10 or separates the turning member 20 from the belt 10, the user removes the cover 40 from the periphery of the belt 10. Then, the spring 41 and the button 39 are released and simultaneously the rib 39*a* is removed from the groove 33 of the pin 34, thereby separating the pin 34 from the second fixing member 37. Accordingly, the user takes off the belt from the body through the release of the locking means 30.

Figure 5:
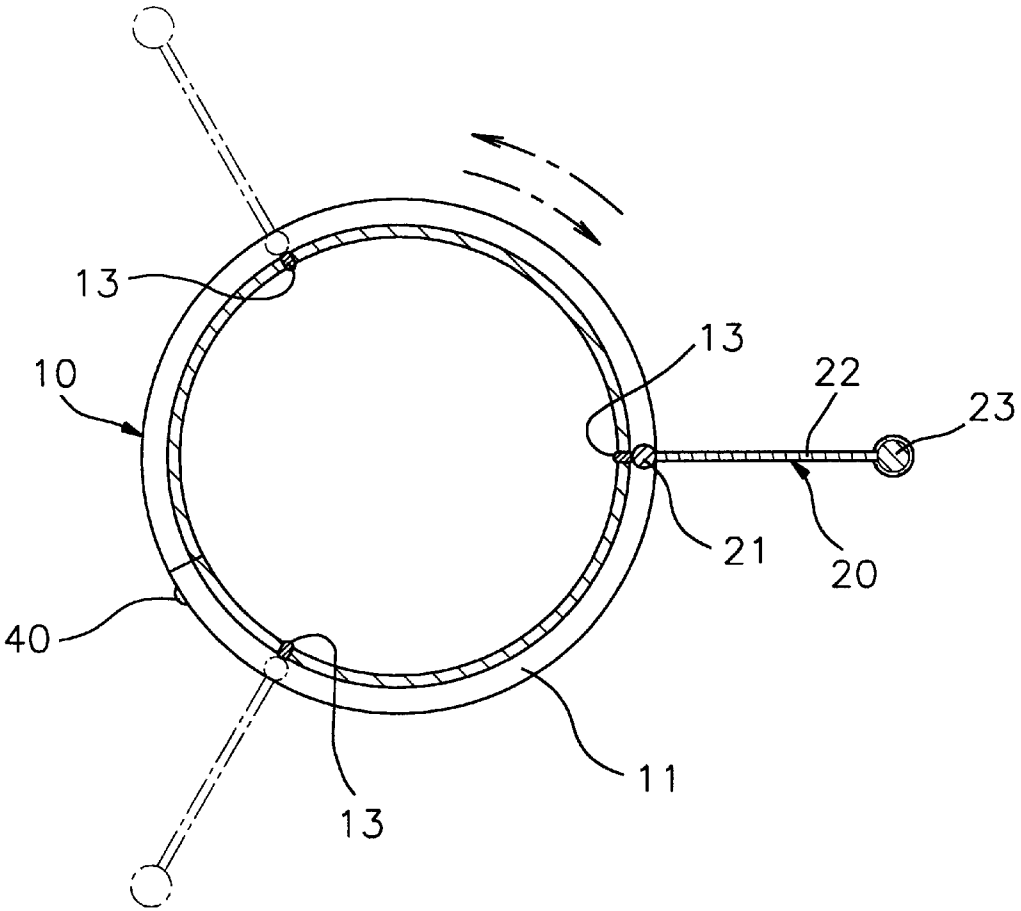
FIG. 5 is a sectional view showing the operating state of the entertainment and exercise device according to the first embodiment of the present invention.

FIG. 5 is a sectional view showing the operating state of the entertainment and exercise device according to the first embodiment of the present invention.

As shown in FIG. 5, when the user wears the entertainment and exercise device 1 on his body and swivels his body, the first mass 21 of the turning member 20 rotates along the guide recess 11 of the belt 10, and the connecting bar 22 and the second mass 23 rotate together with rotation of the turning member 20. The user obtains the exercise effect by means of the swiveling exercise of the body, and a finger-pressure effect of the body contacting the permanent magnets 13.

Figure 6:
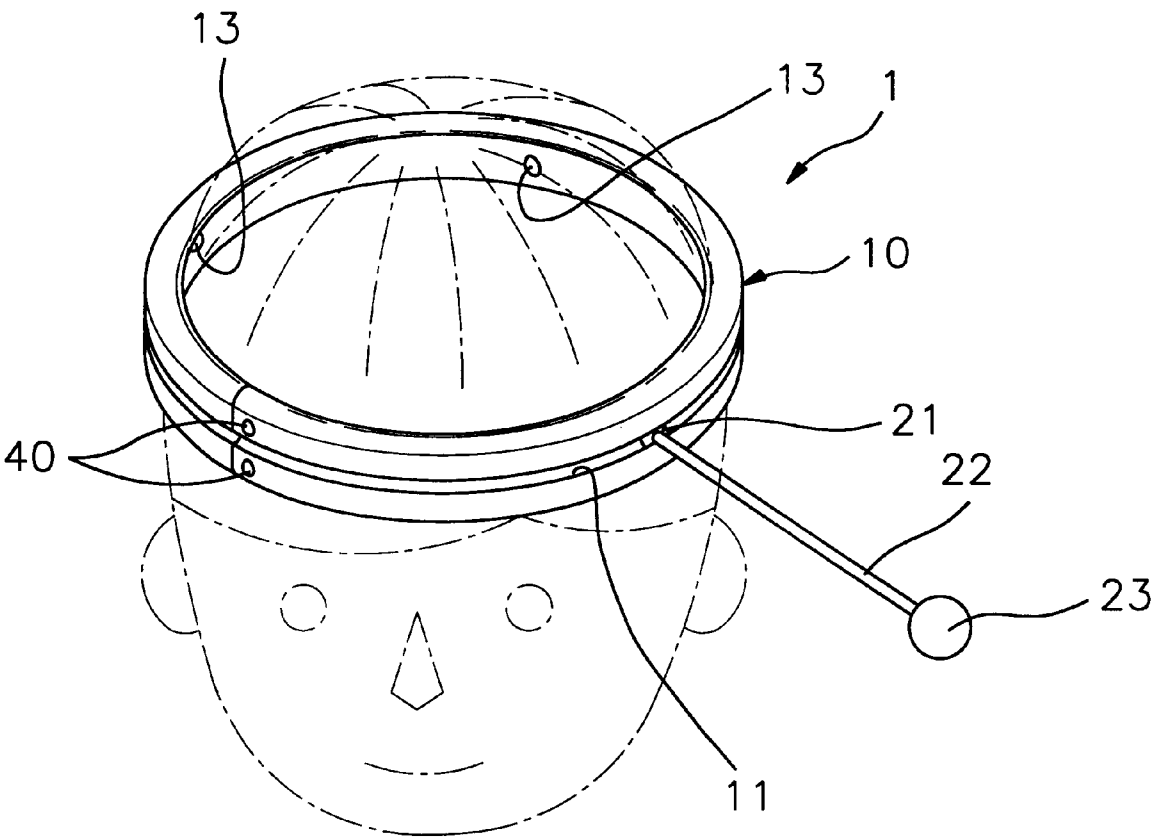
FIG. 6 is a perspective view showing the entertainment and exercise device placed at a person's head.
Figure 7:
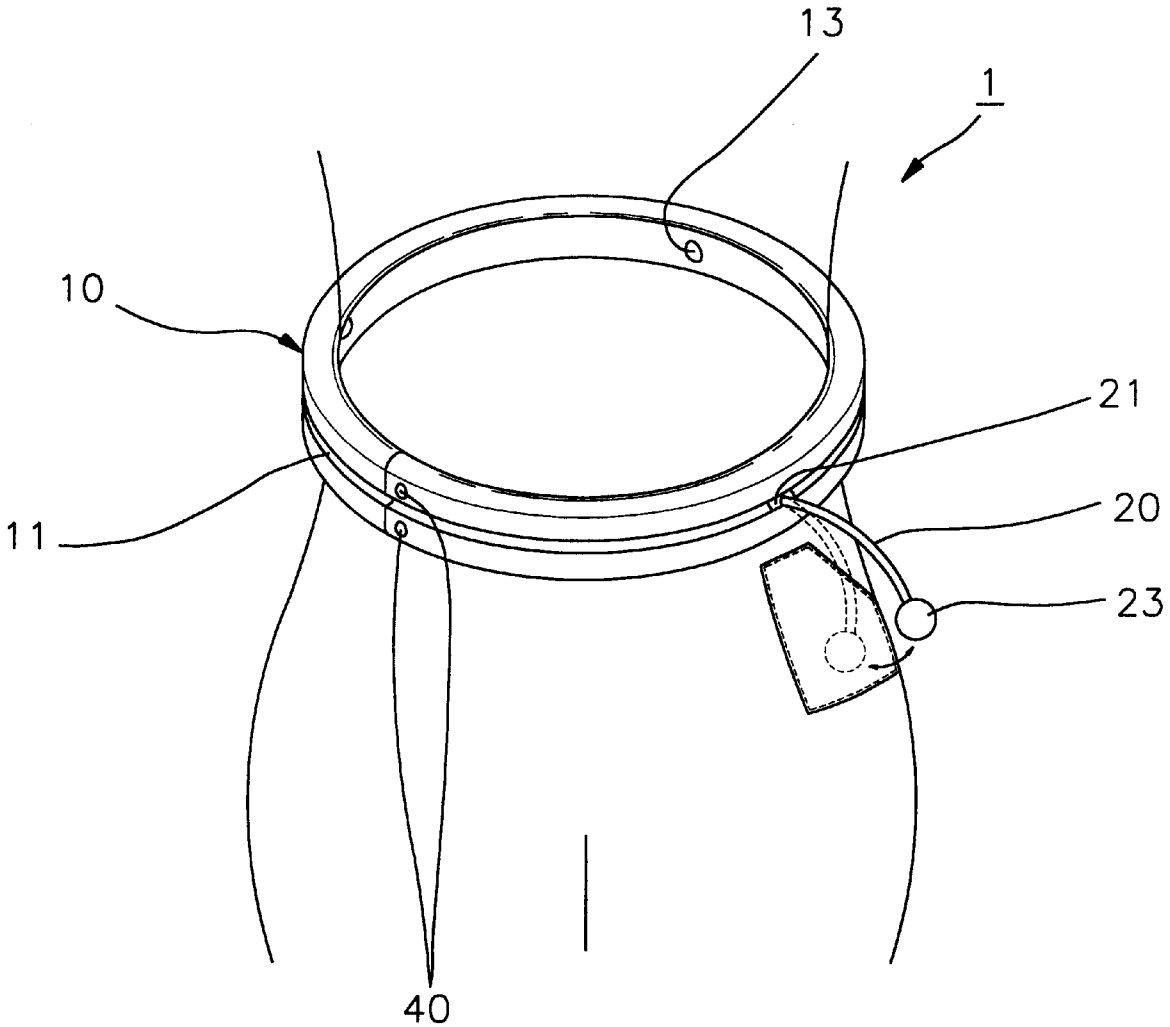
FIG. 7 is a perspective view showing the entertainment and exercise device placed at a person's waist.

FIG. 6 is a perspective view showing the entertainment and exercise device placed on the head, and FIG. 7 is a perspective view showing the entertainment and exercise device placed at the waist.

As shown in FIG. 6, the user wears the belt 10 on his head and swivels the head, the turning member 20 rotates along the guide recess 11 of the belt, and the permanent magnets 13 installed in the inner periphery of the belt 10 slightly apply pressure to the head.

As shown in FIG. 7, the connecting bar 22 of the turning member 20 is made from flexible material such as plastic, so that the user bends the connecting bar 22 of the turning member 20 and easily keeps the second mass 23 in the user's pocket.

Hereinafter, a second preferred embodiment according to the present invention will be described in detail.

Figure 8:
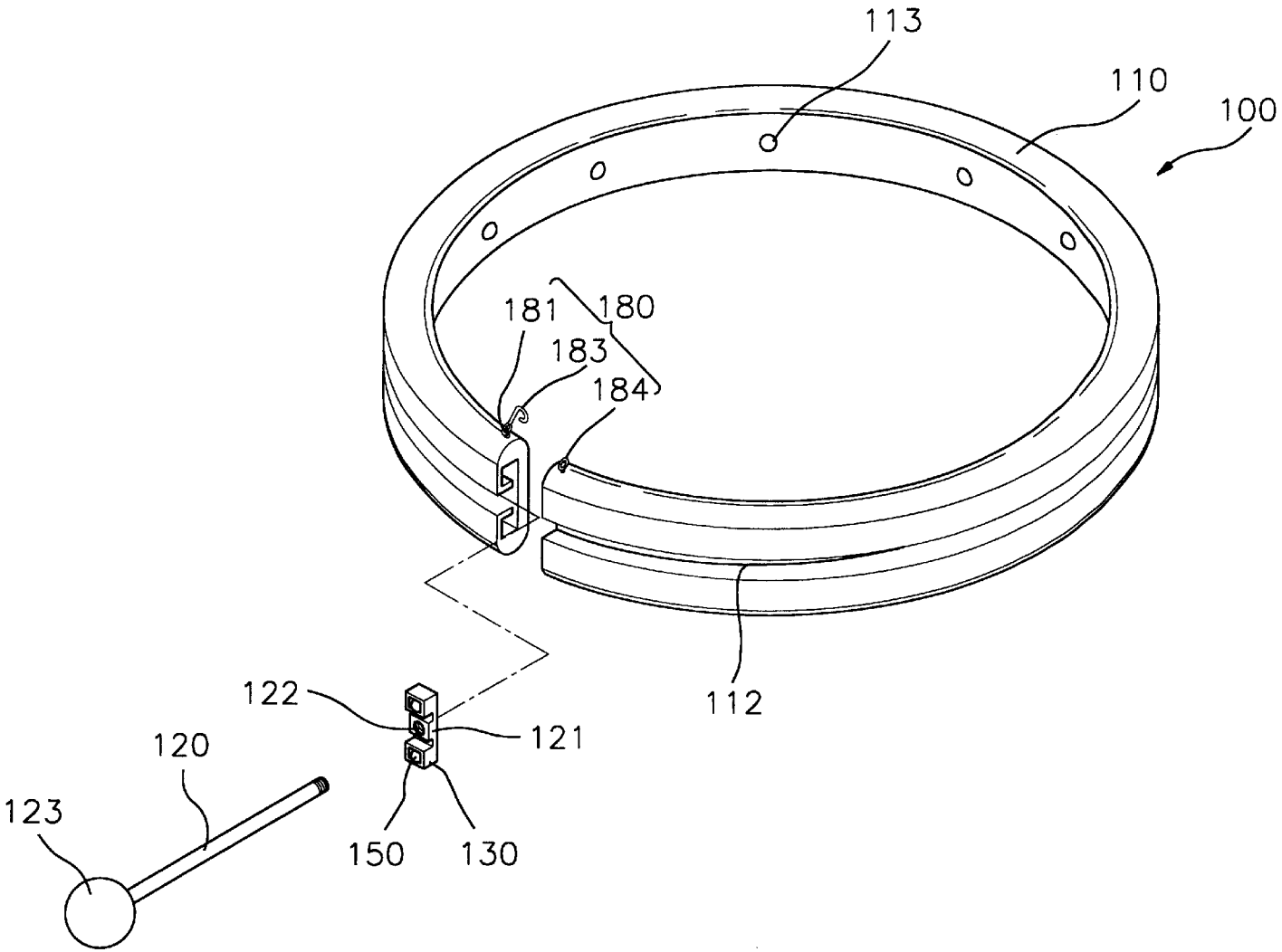
FIG. 8 is a perspective view of an entertainment and exercise device according to a second embodiment of the present invention.
Figure 9:
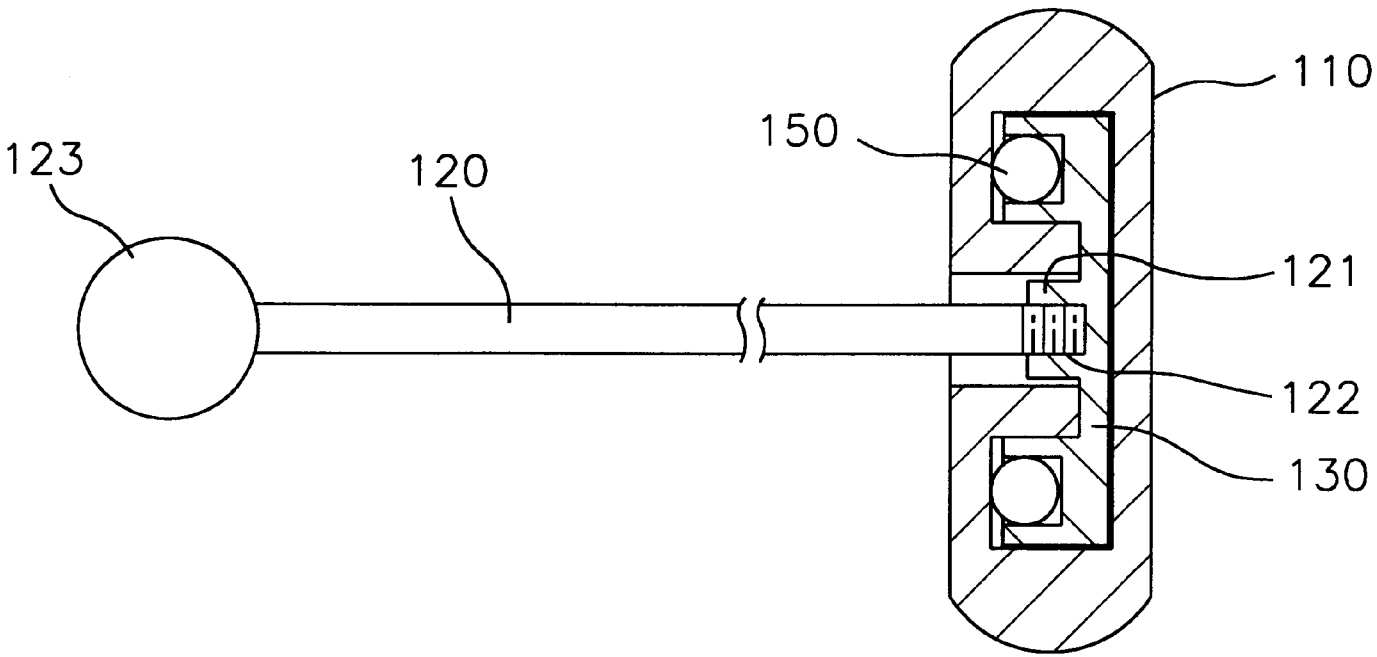
FIG. 9 is a sectional view of the entertainment and exercise device of FIG. 8.

FIG. 8 is a perspective view of an entertainment and exercise device according to a second embodiment of the present invention, and FIG. 9 is a sectional view of the entertainment and exercise device of FIG. 8.

As shown in FIG. 8 and FIG. 9, a belt 110 of the entertainment and exercise device has a C-shaped guide rail 112. A sliding plate 130 rotating along the guide rail 112 is installed in the guide rail 112. The sliding plate 130 has a ball bearing 150 at each of two end portions and a protrusion 121 forming a thread hole 122 at a central portion. One end of turning member 120 is separably screwed into the thread hole 122 of the protrusion 121, and a mass 123 is integrally formed at the other end of the turning member 120.

Further, a locking means 180 for connecting and disconnecting the belt 110 is installed on the disconnected belt 110.

The locking means 180 has a pair of lugs 181 projected respectively on an upper face and an lower face of one part of the disconnected belt 110, a pair of hooks 183 connected to each lug 181, and a pair of rings 184 projected respectively on an upper face and an lower face of the other part of the disconnected belt 110. Each hook 183 is separably combined with each ring 184.

A plurality of permanent magnets 113 is projected on an inner periphery of the belt 110 in contact with the person's body in order to obtain a finger-pressure effect.

Hereinafter, the operation of the second embodiment according to the present invention will be described.

When the user wears the belt 110 on his body and hangs the hook 183 on the ring 184, the belt 110 is secured to his body. In this state, when the user swivels his body, the ball bearing 150 rolls about an inner wall of the guide rail 112, thereby the sliding plate 130 rotates along the guide rail 112. Accordingly, the turning member 120 connected with the sliding plate 130 rotates so that the user undertakes exercise and obtains a finger-pressure by the permanent magnets 113.

Further, when the user doesn't use the entertainment and exercise device, the turning member 120 is separated from the sliding plate 130.

Hereinafter, a third embodiment according to the present invention will be described in detail.

An entertainment and exercise device 300 according to the third embodiment of the present invention is the same as that of the second embodiment except for substituting an I-shaped guide rail 312 and a carrier 330 for the C-shaped guide rail 112 and the sliding plate 130. Thus, the description for the other portions will be omitted.

Figure 10:
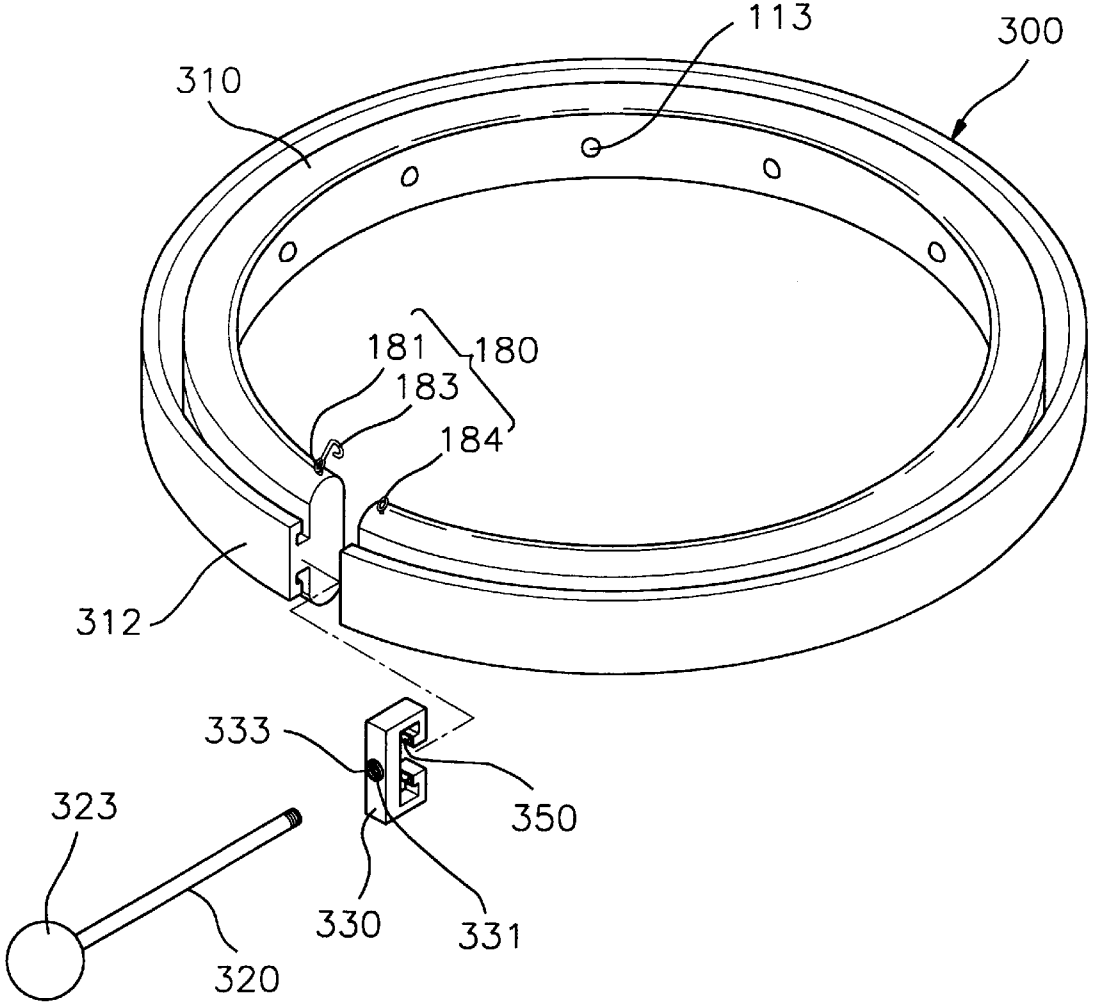
FIG. 10 is a perspective view of an entertainment and exercise device according to a third embodiment of the present invention.
Figure 11:
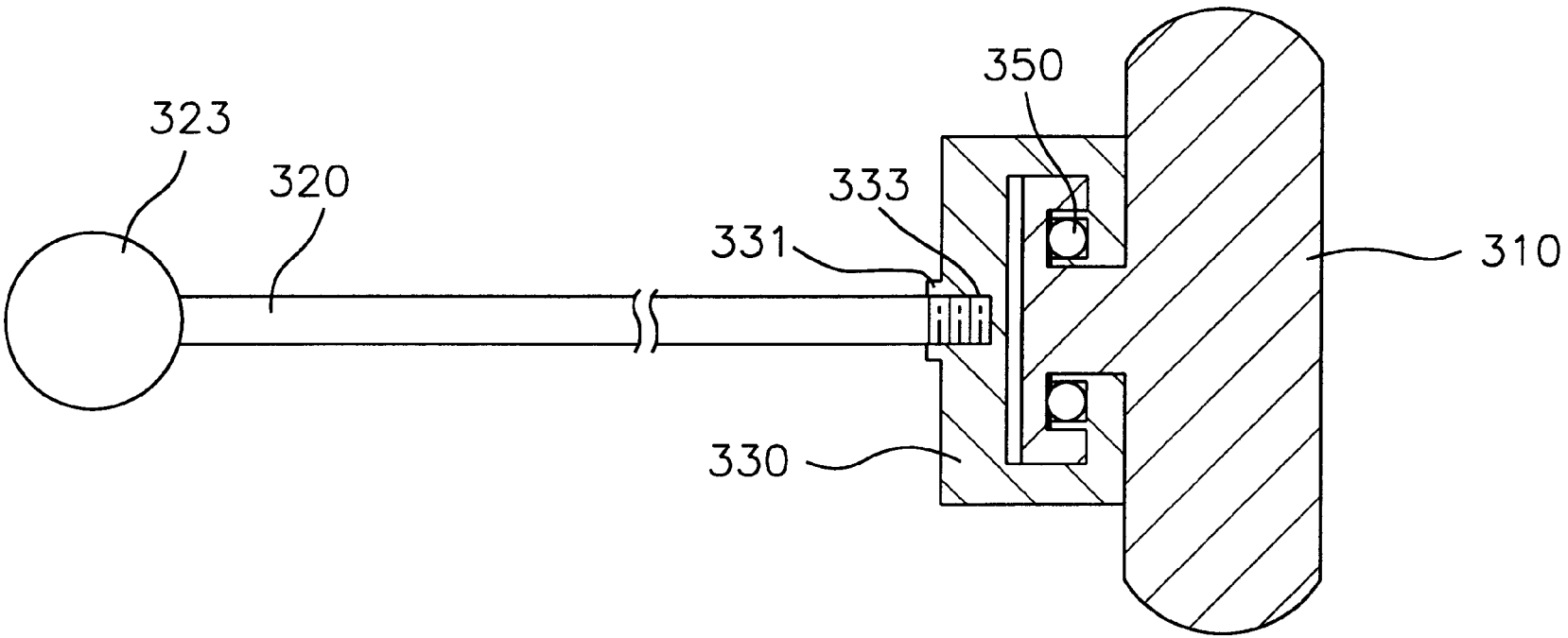
FIG. 11 is a sectional view of the entertainment and exercise device of FIG. 10.

FIG. 10 is a perspective view of an entertainment and exercise device according to a third embodiment of the present invention, and FIG. 11 is a sectional view of the entertainment and exercise device of FIG. 10.

As shown in FIG. 10 and FIG. 11, a belt 310 of the entertainment and exercise device 300 has an I-shaped guide rail 312. A carrier 330 movable along the guide rail 312 is installed on an upper portion of the guide rail 312. The carrier 330 has two ball bearings 350 between both end portions of the carrier 330 and the upper portion of the guide rail 312, and a protrusion 331 forming a thread hole 333 at a central portion. One end of turning member 320 is separably screwed into the thread hole 333 of the protrusion 331, and a mass 323 is integrally formed at the other end of the turning member 320.

Hereinafter, a forth embodiment according to the present invention will be described in detail.

Figure 12:
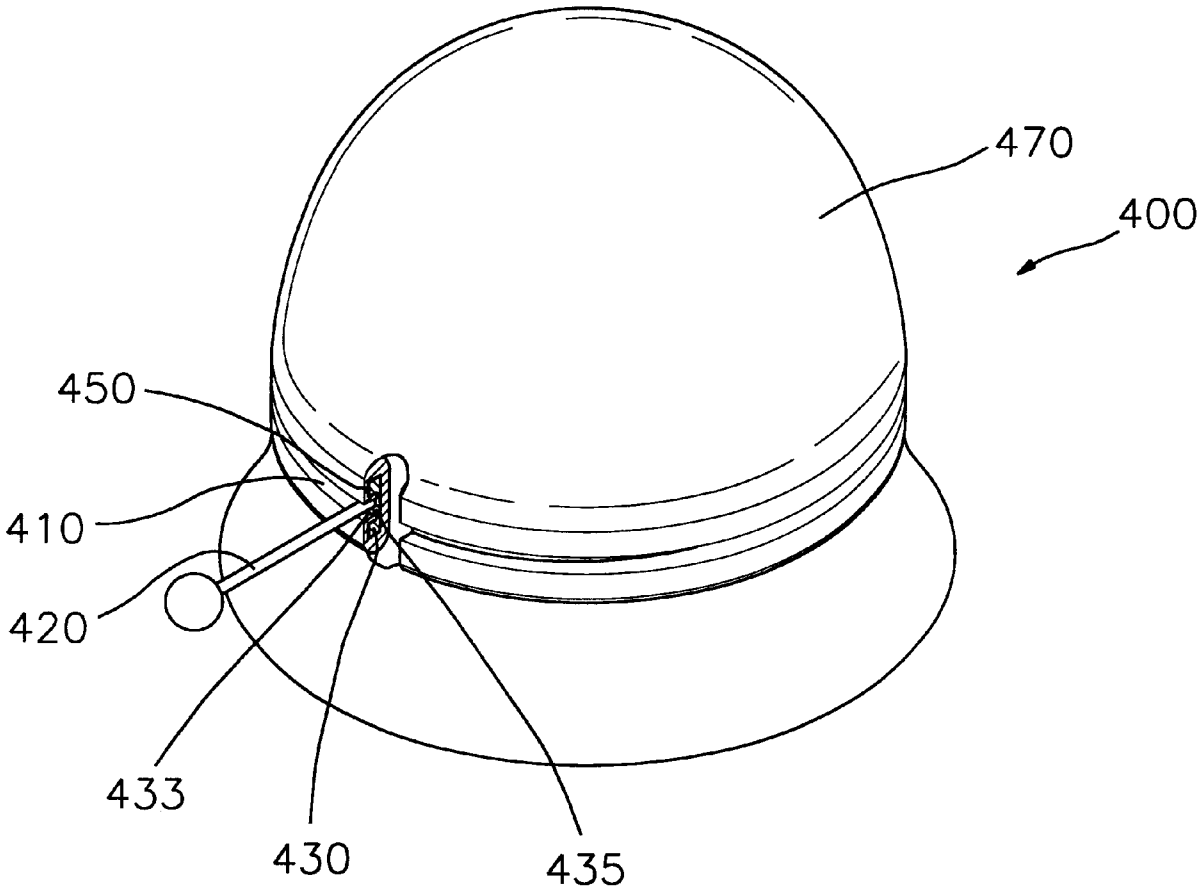
FIG. 12 is a perspective view of an entertainment and exercise device according to a fourth embodiment of the present invention.

FIG. 12 is a perspective view of an entertainment and exercise device according to a fourth embodiment of the present invention.

As shown in FIG. 12, the entertainment and exercise device 400 has a C-shaped guide rail 410 integrally formed on a helmet 470. A sliding plate 430 is installed in the guide rail 410. The sliding plate 430 has a ball bearing 450 at each of both ends thereof and a protrusion 435 forming a thread hole 433 at the central portion. A turning member 420 is separably screwed into the thread hole 433 of the protrusion 435.

Accordingly, when the user wears the helmet 400 on his head and swivels the head, the turning member 420 rotates along the guide rail 410. Thus, the user will be amused and have proper exercise.

Furthermore, the other embodiments of the present invention are substituted for the C-shaped guide rail 410.

As mentioned above, the entertainment and exercise device of the present invention is convenient to carry and store, thereby being used for exercise irrespective of the exercising area. Also, the entertainment and exercise device obtains a simple finger-pressure effect and increases amusement.

While this invention has been specifically shown and described with reference to the particular embodiments thereof, it will be understood by those skilled in the art that various changes in form and detail may be effected therein without departing from the spirit and scope of the invention as defined by the appended claims.

What is claimed is:

1. An entertainment and exercise device comprising:

a belt being circular and flexible, of which one portion is disconnected;

a turning member rotating along a periphery of the belt and elongated outwardly from the belt;

a rotating means installed on the periphery of the belt for rotating the turning member; and a locking means installed in the belt for connecting and disconnecting the belt.

2. The entertainment and exercise device according to claim 1, wherein the rotating mean s comprises:

a guide rail having a C-shaped section and longitudinally formed on the periphery of the belt; and a sliding plate inserted in the guide rail to slide along the guide rail, the sliding plate having a ball-bearing at each of two end portions and a protrusion at a central portion.

3. The entertainment and exercise device according to claim 1, wherein one end of the turning member is separably jointed with the protrusion.

4. The entertainment and exercise device according to claim 3, wherein a noctilucent mass is integrally formed on the other end of the turning member, being made from a rubber.

5. The entertainment and exercise device according to claim 3, wherein the locking means comprises:

a lug projected respectively on an upper face and a lower face of one part of the disconnected belt;

a hook connected to the lug; and a ring projected respectively on an upper face and an lower face of the other part of the disconnected belt, wherein the hook is separably combined with the ring.

6. The entertainment and exercise device according to claim 1, wherein the rotating means comprises:

a guide rail having an I-shaped section and longitudinally formed on the periphery of the belt; and a carrier supporting an upper portion of the guide rail to slide along the guide rail, the carrier having two ball-bearings between both end portions of the carrier and the upper portion of the guide rail, and a protrusion at a central portion.

7. The entertainment and exercise device according to claim 6, wherein one end of the turning member is separably jointed with the protrusion.

8. The entertainment and exercise device according to claim 7, wherein a noctilucent mass is integrally formed on the other end of the turning member, being made from a rubber.

9. The entertainment and exercise device according to claim 7, wherein the locking means comprises:

a lug projected respectively on an upper face and an lower face of one part of the disconnected belt;

a hook connected to the lug; and a ring projected respectively on an upper face and an lower face of the other part of the disconnected belt, wherein the hook is separably combined with the ring.

10. An entertainment and exercise device comprising:

a disconnected belt being circular and flexible, and forming a guide recess along a longitudinal periphery of the belt;

a turning member rotating along a longitudinal periphery of the belt and elongated outwardly from the belt, the turning member having a first mass rotatably inserted in the guide recess of the belt, a connecting bar of which one end is connected with the first mass, and a second mass jointed with the other end of the connecting bar; and a locking means installed in the belt for connecting and disconnecting the belt.

11. The entertainment and exercise device according to claim 10, wherein a pair of first holes are formed on an end face of one part of the disconnected belt, a pair of second holes are formed on an end face of the other part of the disconnected belt, and a pair of securing holes are formed on the periphery of the other part of the disconnected belt in order to vertically communicate with the second holes.

12. The entertainment and exercise device according to claim 11, wherein the locking means comprises:

a first fixing member inserted in each first hole;

a second fixing member inserted in each second hole and forming a slit in a periphery thereof;

a pin of which one end is screwed into the first fixing member and the other end is inserted in the second fixing member, the pin having a groove formed along a periphery of the other end thereof;

a button inserted in each securing hole and having a rib fitted into the groove of the pin through the slit of the second fixing member;

a spring placed on a head portion of the button for applying elastic force on the button; and a cover for restraining movement of the spring and covering the securing hole.

13. An entertainment and exercise device comprising:

a helmet for wearing on a person's head;

a rotating means integrally installed on a peripheral area of the helmet; and a turning member separably combined with the rotating means and elongated outwardly from the helmet.

14. The entertainment and exercise device according to claim 13, wherein the rotating means comprises:

a guide rail having C-shaped section and longitudinally formed on the periphery of the helmet; and a sliding plate inserted in the guide rail to slide along the guide rail, the sliding plate having a ball bearing at each of two end portions and a protrusion at a central portion.

* * * * *